United States Patent [19]

Eady

[11] Patent Number: 4,743,026

[45] Date of Patent: May 10, 1988

[54] GOLF GAME

[76] Inventor: Gordon E. Eady, 151 Ross Street, Renfrew, Ontario, Canada, K7V 2H9

[21] Appl. No.: 852,213

[22] Filed: Apr. 15, 1986

[30] Foreign Application Priority Data

May 23, 1985 [CA] Canada ..... 482157

[51] Int. Cl.[4] ..... A63B 67/02; A63F 7/06

[52] U.S. Cl. ..... 273/176 F; 273/176 L; 273/181 R; 273/245; 273/87 C; 273/87 F

[58] Field of Search ..... 273/176 F, 176 FA, 176 FB, 273/176 L, 87 C, 87 R, 87 F, 245, 181 R

[56] References Cited

U.S. PATENT DOCUMENTS

| | | | |
|---|---|---|---|
| 1,403,345 | 1/1922 | Orr | 273/176 L |
| 1,470,117 | 10/1983 | MacKae . | |
| 1,552,183 | 9/1925 | Wright . | |
| 1,736,523 | 11/1929 | Decker . | |
| 1,781,230 | 11/1930 | Hill . | |
| 1,851,423 | 3/1932 | Ely . | |
| 1,914,365 | 6/1933 | Ford . | |
| 2,180,049 | 11/1939 | Hall . | |
| 2,248,053 | 7/1941 | Bale . | |
| 3,165,930 | 1/1965 | Halpern et al. . | |
| 3,260,526 | 7/1966 | Seitz | 273/245 |
| 3,342,494 | 9/1967 | Talley Jr. . | |
| 3,584,877 | 6/1971 | Florian | 273/176 FB |
| 3,727,918 | 4/1973 | Zawacki | 273/176 FB |
| 3,843,136 | 10/1974 | Buenzle . | |
| 3,857,568 | 12/1974 | Yoder . | |
| 3,910,581 | 10/1975 | Nicholson . | |
| 3,912,270 | 10/1975 | Trossman et al. | 273/245 |
| 3,944,229 | 3/1976 | Feeney . | |
| 3,944,232 | 3/1976 | Tierney | 273/176 FB |
| 3,989,249 | 11/1976 | Breslow . | |
| 4,017,084 | 4/1977 | Jeffery | 273/176 FB |
| 4,042,246 | 8/1977 | Strandgard . | |
| 4,093,222 | 6/1978 | Eshleman . | |
| 4,093,233 | 6/1978 | Barbarow . | |
| 4,113,260 | 9/1978 | Sain . | |
| 4,134,590 | 1/1979 | Conrad | 273/245 |
| 4,203,604 | 5/1980 | La Grange | 273/176 FB |

FOREIGN PATENT DOCUMENTS

| | | | |
|---|---|---|---|
| 278628 | 3/1928 | Canada . | |
| 771058 | 11/1967 | Canada . | |
| 807049 | 2/1969 | Canada . | |
| 1083627 | 8/1982 | Canada . | |
| 2123303 | 2/1984 | United Kingdom | 273/245 |
| 2151145 | 7/1985 | United Kingdom | 273/245 |

*Primary Examiner*—Gary L. Smith
*Assistant Examiner*—Eric K. Nicholson

[57] ABSTRACT

A golf game has a flexible playing medium on which one region is utilized for simulating golf shots other than putting shots, and the other region is utilized for simulating putting shots. A series of charts each depict a respective different one of the links of a golf course. A player hits their ball along the non-putting region of the medium and moves a marker on the chart to assume a position corresponding to that at which their ball comes to rest on the medium. When the marker comes within a region of the chart delineated as the putting green of the link the player's next shot is made on the putting region of the medium. The element of chance may be incorporated into the game by requiring the player to move his marker on the chart according to chance selection if the ball comes to rest on one of a series of designated areas on the non-putting region of the medium.

7 Claims, 3 Drawing Sheets

GOLF GAME

This invention relates to a golf game, and more particularly, to a game which may be played on a storable medium and may include the elements of both skill and chance.

A number of games have previously been developed based on the game of golf and involving hitting a golf ball with a club along a representation of a link of a golf course. One such game is described in U.S. Pat. No. 4,093,233, granted to Charles A. Barbarow on Jun. 6, 1978. In the game of that reference a player stands a selected distance from a plurality of scoring zones defined by a pair of spaced support members, the player hitting the ball such that it lands within one of the scoring zones. In one form of playing the game, a marker is advanced on a game board according to the scoring zone upon which the ball comes to rest. The marker is moved to one of a number of discrete positions between a tee position and a hole position for each of the ten links depicted on the game board. Certain of the discrete positions have associated with them an element of chance; a player who is required to move his marker to such a position, according to where his ball comes to rest in the scoring zone, is required to draw a card; the card may require the player to either advance or retard his position on the game board. In the foregoing fashion, the players advance from link to link on the game board according to their skill in hitting a golf ball and also according to chance if their ball should land on one of the positions associated with card selection.

U.S. Pat. No. 1,781,230, granted to H. Hill on Nov. 11, 1930, discloses an apparatus for playing golf in a restricted space, which apparatus has a series of laterally offset receptacles acting as the equivalent of the scoring zones of U.S. Pat. No. 4,093,233. A game board is provided on which nine links are depicted, each link having five sets of laterally-offset positions for each of a series of positions between the tee and the green.

Additionally, each green has a matrix of five-by-five positions, the central position of which is a hole position. Each of the players has a marker which is moved from position to position on the board according to the receptacle of the apparatus in which the ball of the player comes to rest. This reference has the feature over the foregoing reference that a penalty is recognized if the golf ball is either "pulled" or "sliced".

U.S. Pat. No. 3,342,494, granted to R.B. Talley, Jr. on Sept. 19, 1967, and U.S. Pat. No. 3,843,136, granted to F.L. Buenzle on Oct. 22, 1974, both disclose an apparatus, including a length of carpet, for playing a game simulating a round of golf. The game of each of those references is played in a similar fashion, a player first hitting the ball from one end of the carpet toward the other end and having their second hitting position determined by the accuracy of the first hit, the closeness of the return hitting position to the first end of the carpet varying with the proximity attained by the ball to the second end of the carpet. Utilizing a length of carpet has the obvious advantage that the playing surface may be rapidly and easily stored.

The subject invention is a golf game that combines many of the advantages of the foregoing games and has additional advantages. The invention is a golf game adapted to be used in association with a golf club and a golf ball, the game comprising a storable flexible medium having marking denoting a playing surface for the game, a series of charts each depicting in plan view a different link of a golf course, a series of markers for the charts, and a series of scorecards by means of which the players keep track of their score. The surface of the flexible medium is divided into a pre-putting region and a putting region by a line of demarcation. The pre-putting region has a tee-off zone proximate of its one end and has a series of target zones between the tee-off zone and the opposite end, the target zones extending parallel to the ends of the pre-putting region. The pre-putting region is also divided longitudinally between its ends such that each target zone has a central portion and at least one lateral portion on each side of the central portion. Each chart of the series of charts is divided by longitudinal and lateral lines. The longitudinal lines extend from the tee-off area toward the hole area and divide the chart into longitudinal divisions corresponding to the central portion and lateral portions of the target zones on the flexible medium. The distance represented by the separation between each adjacent pair of lateral lines has a relationship to the separation between the lateral edges of the target zones.

The game of the invention is played by each player in turn first hitting the ball from the tee-off zone of the pre-putting region of the flexible medium. After hitting the ball, the player places a marker at the position on the particular chart corresponding to the longitudinal and lateral position at which the ball comes to rest on the flexible medium. According to the position of the marker on the chart, the ball is rehit by the player from the tee-off zone of the pre-putting region of the flexible medium and the marker is moved to a position further along the chart according to the new position at which the ball comes to rest on the flexible medium. Such hitting of the ball is repeated until the marker on the chart is within a pre-selected distance of the hole on the chart. The player then moves to the putting region of the flexible medium and hits the ball until it moves within a hole designation in that region. The players enter on their scorecards the strokes required to complete the link.

The game of the invention may further comprise chance game movement selection means associated with certain of the target zones of the pre-putting region of the flexible medium. In this form of the game, a ball hit by a player from the tee-off zone of the pre-putting region of the flexible medium may come to rest on the one of the target zones associated with the selection means. In such case, the position of the marker of the player on the particular chart is modified according to the selection means. That selection means may comprise a series of cards each of which has described thereon a penalty or bonus. The player whose ball comes to rest on the one of the target zones associated with the selection means has to randomly select one of the cards, the position of the marker of the player on the particular chart being moved according to the description on the chosen card. The penalty descriptions on the series of cards generally require the players to move back their markers on the board to some extent and the bonus descriptions on the series of cards generally require the players to advance their markers on the board to some extent.

The storable flexible medium may be a piece of carpet capable of being rolled up. On such carpet the direction of play in both the pre-putting and putting regions is parallel to the line of demarcation between the two regions. The marking on the pre-putting region of the playing surface may include a series of small delineated areas each of which is located within a respective one of the target zones. A player whose ball comes to rest on one of such delineated areas when hit from the tee-off zone is credited with scoring a hole-in-one in the game.

The invention will next be described in terms of a preferred embodiment, utilizing the accompanying drawings in which.

Figure 1:
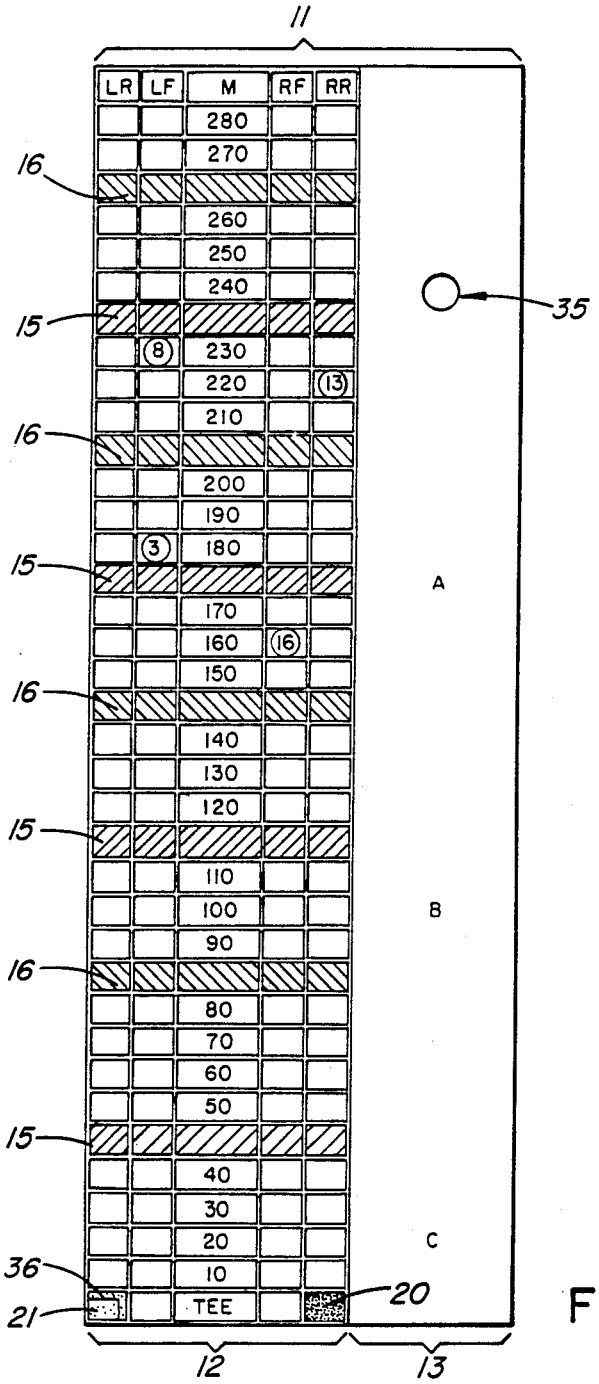
FIG. 1 is a plan view of the playing surface of the game, that playing surface including both a pre-putting region and a putting region

With reference to FIG. 1, playing surface 11 is divided into a pre-putting region 12 and a putting region 13. Pre-putting region 12 is in turn generally divided into a grid by four lines extending longitudinally in the region and thirty-seven lines extending laterally in the region. One end of the pre-putting region 12 is identified as the TEE, and it is from this end of that region that each player hits his ball until such time as he qualifies to play on the surface of putting region 13. The pre-putting region 12 is intended to be representative of the fairway and the rough on either side of the fairway of a golf link. The central longitudinal division of pre-putting region 12, extending from TEE to M, is intended to depict the middle fairway of a golf link. The longitudinal divisions on either side of that central division represent the left and right fairways, respectively designated LF and RF. The longitudinal divisions on either side of the left and right fairways are intended to represent the left and right rough areas of the golf link, LR representing the left rough and RR representing the right rough.

Figure 4:
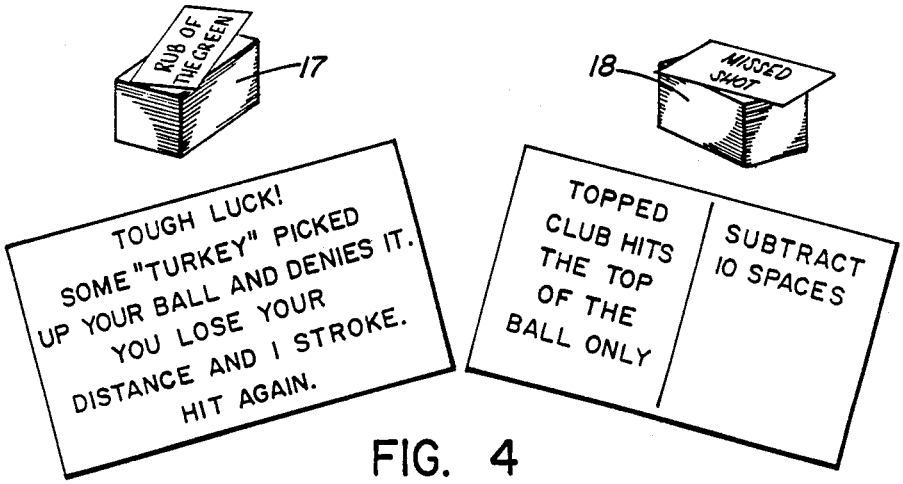
FIG. 4 is a perspective view of a double series of cards utilized in the game, and a sample text from each of the cards.

The alternately-designated zones, 15 and 16, on FIG. 1 are zones representing the chance selection means of the game. As will be more fully explained subsequently, if the ball hit by a player from the TEE should come to rest within one of the zones, 15 or 16, then the player is required to draw a card from a corresponding one of two piles of cards, 17 and 18, generally illustrated in FIG. 4. A ball coming to rest on one of the zones 15 would require the player to draw a card from the top of the pile of cards 17 designated RUB OF THE GREEN, and correspondingly, a ball coming to rest on one of the zones 16 would obligate the player to draw a card from the pile of cards 18, designated MISSED SHOT. Each of the RUB OF THE GREEN cards denotes the occurrence of a chance external factor, such as someone picking up the ball, whereas MISSED SHOT cards denote a defective shot by the player, such as a club topping the ball. The bonus or penalty associated with the cards generally requires the player to move forward, backward or sideward.

The playing surface is formed from a piece of all-weather carpeting twelve feet long and four feet wide, the pre-putting region being thirty-three inches wide and the putting region being fifteen inches wide. The longitudinal division marked M is nine inches wide, the longitudinal divisions LF and RF are 6 inches wide, and the longitudinal divisions LR and RR are 6 inches wide. The overall colour of the carpet is preferably green, with white lettering and lines as shown in FIG. 1. The zones 15 are red and the zones 16 are yellow. Two other colours are utilized on the carpet, blue being utilized for the small zone designated 20 in FIG. 1 and brown being utilized for the zone designated 21 in that Figure; the reason for zones 20 and 21 will subsequently become apparent. Four circled numbers are shown in the pre-putting region 12 of FIG. 1 and their purpose will also subsequently become apparent.

Figure 2:
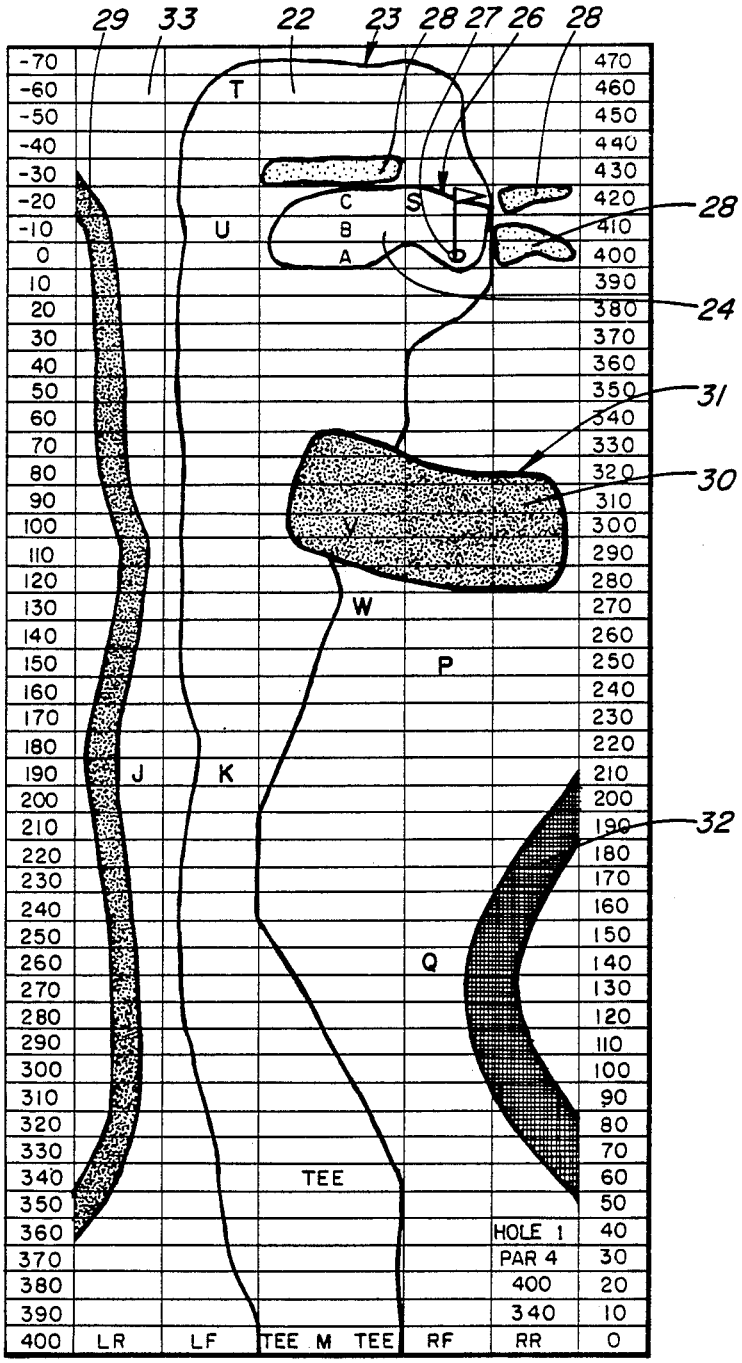
FIG. 2 is a plan view of a representative one of the series of charts utilized in the game.
Figure 3:
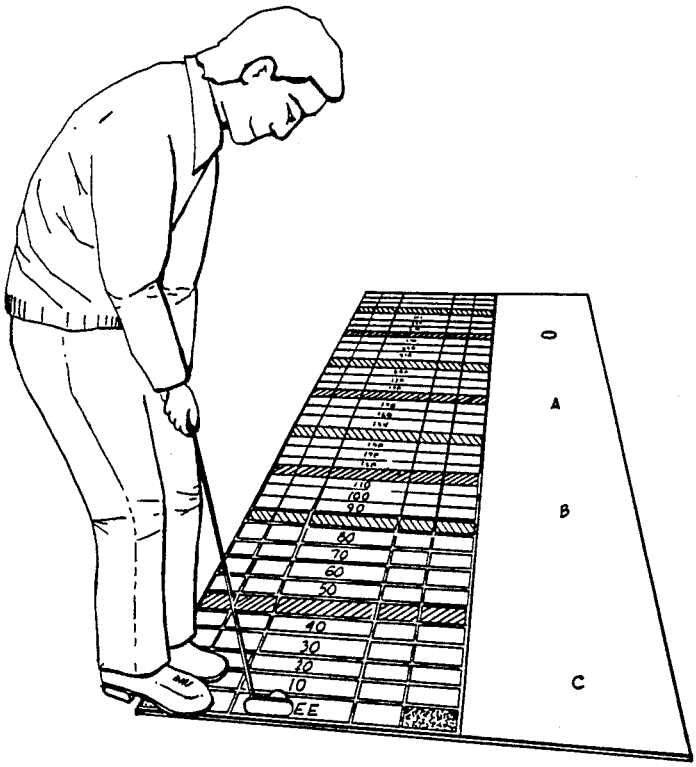
FIG. 3 is a perspective view depicting a person teeing-off on the playing surface of FIG. 1.

FIG. 2 illustrates a representative one of the series of charts utilized with the game. Eighteen charts are provided with each game, and each of those charts depicts a respective one of the golf links of a golf course; charts for nationally-known golf courses would be made available. The term "link" as used in this document refers to the area between the tee and the putting green and also both the laterally-surrounding area and the area beyond the putting green on which a ball might reasonably be expected to land during play of the game, i.e. the area encompassed by both the terms "fairway" and "rough".

The area 22 within the heavy line 23 on the chart of FIG. 2 is an artistic representation of the fairway of the golf link; such artistic representation has no bearing on the playing of the game. Since the playing surface of the carpet has to be compatible with the link layouts on all of the charts, the carpet surface represents the fairway in a simplified rectilinear form. The area 24 within the heavy line 26 on FIG. 2 is the putting green of the golf link on the chart, and small circle 27 is the hole on putting green 24. The areas designated 28 are "sand traps", and the thin band 29 is a stream representing a "lateral water hazard". The area 30 within heavy line 31 is a "regular water hazard", and the band 32 is a roadway that intersects the golf link. The remaining region on the chart of FIG. 2 and between the double row of numbers there shown is the "rough" of the golf link; that region will henceforth be designated as rough 33. The chart of FIG. 2 is colour-coded, with fairway 22 being light green, putting green 24 being dark green, sand traps 28 being brown, lateral water hazard 29 being blue, regular water hazard 30 being also blue, roadway 32 being black, and the remainder of the chart being white. The numbers on the right side of the chart of FIG. 2 represent the yardage from the tee on the link, and the numbers on the left side of the chart represent yardage measured from hole 27.

The charts representing the eighteen links of a golf course are preferably made of a light cardboard into which coloured pins may be inserted as markers. Each player has a set of ten pins having a distinctive colour from the pins of other players. The game is intended for play by one to six players, and is best suited to two to four players.

The game is commenced by the players flipping a coin or using other means to determine the order of play. On the second and subsequent links the order of play is determined by the scores attained on the previous link, the player with the lower score on the previous link playing the first shot on the subsequent link. The players in turn tee-off their ball from the central zone marked TEE on the pre-putting region 12. The golf club used by each player would normally be a putter, and the ball used would normally be a regular golf ball. The chart of FIG. 2 which represents the first link of the golf course is studied by each player to determine how the hole is "to be played". In that regard, each game of golf may be played on either a "championship" course or a "regular" course. The chart of FIG. 2 illustrates the difference. The regular first hole depicted in FIG. 2 has a tee positioned 340 yards from the hole, whereas the championship first hole has the tee position 400 yards from the hole, i.e. at the one end of the chart.

Although the player must keep in mind the particular chart associated with the golf link when teeing off, they must also consider the position of the chance zones 15 and 16 on the carpet. If their golf ball comes to rest on one of those zones a card must be drawn from the corresponding one of the piles of cards 17 and 18. If, for instance, the ball on the first shot comes to rest on the zone 15 positioned between the yardage markers "230" and "240" of FIG. 1, then the top card must be drawn from the pile of cards 17. Assuming that the representative card associated with the pile of cards 17 in FIG. 4 were drawn, the player has to play their third shot again fron the tee; in other words, no yardage was gained on the first shot. If, on the other hand, the ball had come to rest on the zone 16 between the yardage indicators "200" and "210" of FIG. 1 the player would draw the top card from the pile of cards 18. If the top card contained the representative text associated with the pile of cards 18 in FIG. 4, the player would move back ten spaces from zone 16; the effect would be the same as if the ball landed on yardage 130. The player would then place a pin on the chart of the link being played, 130 yards from the tee. The five longitudinal divisions on each chart are intended to correspond with the five longitudinal divisions of the pre-putting region 12, and the player's pin is positioned laterally on the chart according to the lateral position at which the ball comes to rest on pre-putting region 12. If a ball lands on a line it is deemed to be in that zone in which the larger amount of the ball rests. If the ball sits exactly on the line, the player may choose which zone he wishes the ball to be in, and, if that choice involves one of the zones 15 or 16, the choice must be made before a card is drawn from the respective pile of cards 17 or 18. A slight exception to the foregoing rules is made when a ball comes to rest with the majority of it off of the pre-putting region 12, but with part of it still on that region; in that case the player is allowed to treat the ball as if the majority of it were on pre-putting region 12.

With reference to FIG. 2, assume that a player tees off from the championship tee at the one end of the chart. The player places his golf ball on the zone marked TEE of the carpet playing surface of FIG. 1 and directs his ball toward one of the positions on the pre-putting region; the player may not necessarily be looking for maximum yardage since tactical considerations come into play, depending upon the configuration of the fairway associated with the particular link. For instance, if the ball comes to rest in the LR longitudinal division at yardage 210 on the carpet, the ball will be resting within one of the corresponding rectangles on the chart of FIG. 2 through which lateral water hazard 29 extends, i.e. rectangle J in FIG. 2. The ball landing anywhere within that particular rectangle on the carpet is treated as being equivalent to the ball landing in lateral water hazard 29. If the player's ball does land in the rectangle on the carpet corresponding to rectangle J on the chart, the next shot must be made from that portion of the carpet tee-off zone designated as 20 in FIG. 1; the player also loses one shot for landing in a water hazard. With respect to the chart of FIG. 2, the player's pin is positioned in the rectangle at yardage 210 that is on the fairway side of the lateral water hazard, i.e. rectangle K.

Assume that the player's ball on the first shot had instead landed anywhere within the rectangle defined by longitudinal division RF and yardage 140. The player's corresponding position on the chart of FIG. 2 is rectangle Q. The player's ball is treated as having gone out-of-bounds. A two-stroke penalty is taken and the player's marker is moved back to the tee, from which position the third shot is taken, i.e. no yardage is recognized from the shot.

With the player keeping in mind the foregoing difficulties, the player would attempt to direct his first shot straight up the fairway, i.e. along the central longitudinal division of pre-putting region 12 that is designated M. Assume that the ball veers slightly to the right and lands within the rectangle defined by the longitudinal division RF and yardage 250. The player places a pin bearing his particular colour into the corresponding rectangle on the chart of FIG. 2; this is shown marked as P on the chart. After the player's first shot, the other players take their corresponding first shot as in a regular game of golf. Also as in a regular game of golf, the players shoot each subsequent shot according to their respective distances from the hole on the previous shot, the player at the greatest distance shooting first.

Assume that the player's ball on the first shot had landed on the rectangle on the carpet corresponding to rectangle P on the chart of FIG. 2. The player is now required to shoot his second shot such that it lands between 150 and 170 yards up the fairway and lands either within the same longitudinal division or the division directly to the left. That area is represented by the six rectangles that are partially cut by putting green 24 on the chart of FIG. 2.

The player places the ball for the second shot on the rectangle between the rectangle marked TEE and zone 20 on the carpet surface of FIG. 1, and rehits. That rectangle is used since the first shot landed on the RF longitudinal division. The player is directing his shot for yardage between 150 and 170 and either the M or RF longitudinal divisions; those six rectangles represent the putting green on the carpet for the particular shot and, if the ball lands on one of those rectangles, would allow the player to move to putting region 13 for his next shot. At this point the player would appreciate that a chance zone 16 sits directly in front of the yardage 150 zone on the carpet surface. Landing on yardage 150 in longitudinal division M or RF would entitle the player to putt on his next shot from position A on putting region 13. Looking at the chart of FIG. 2, the player might decide that his skill level is not sufficient to differentiate between his ball coming to rest on the chance zone 16 and the yardage 150 zone, and might instead attempt to have his ball come to rest on the yardage 160 zone. On the chart of FIG. 2, the yardage 160 zone would correspond to the lateral zone designated B, i.e. 410 yards from the tee; that would allow the player to putt from position B on putting region 13 on his next shot.

Assuming that the ball of the player on the second shot in fact comes to rest on the rectangle defined by the longitudinal division RF and yardage 170 on pre-putting region 12, then the player would place a pin bearing his colour on that rectangle of the chart of link 1 which is designated S in FIG. 2. The player is now within the lateral zone designated C on the chart of FIG. 2, and that position corresponds to the position C on the putting region 13 of the playing surface in FIG. 1. When the player's next turn comes around, the player places the golf ball above the marker C on the putting region 13 of the carpet and has a putt to make of approximately nine feet to the hole 35.

If the player's ball when shot from position P had come to rest instead on position T, the player would play his next shot from that rectangle positioned between the rectangle marked TEE and zone 21. He would then place his ball on the putting green 24 by hitting it on the carpet such that it landed between yardage 40 and 60 inclusive and in longitudinal division M or RF. If the player's ball when hit from position P had come to rest instead on position U, the player would play his next shot from that rectangle positioned between the rectangle marked TEE and zone 21. He would then place his marker on the putting green 24 by hitting the ball on the carpet such that it landed on 0 yardage (a directly lateral shot) or yardage 10 and in longitudinal division M or RF; this would appear to be a trivial shot, but is a necessary one.

With respect to putting region 13, the hole 35 may be an aperture cut in the carpet to better simulate an actual playing surface. As earlier described, the player shoots from that position (A, B, or C) on putting region 13 that corresponds to the proximity with which his last shot on pre-putting 12 came to hole 27; with respect to the link on the chart of FIG. 2, the ball would have to land within one of the six rectangles equating to putting region 24 if it is to be the last shot in that region. The player determines his score on the hole by adding the number of shots required to go from the tee to the hole as in a regular game of golf; the player whose ball landed in the rectangles marked P and S on the chart of FIG. 2 would score a three (a birdie) on the hole, assuming the ball entered the hole 35 on the first shot from position C on putting region 13.

It was previously mentioned that a player shooting from the TEE of the playing surface of FIG. 1 has to keep in mind the position of sand traps and water hazards on the chart of the particular link being played. With respect to link 1, as depicted in FIG. 2, the player would wish to avoid any of the three rectangles defined by the longitudinal division RR and the yardages 400, 410, and 420,and would also wish to avoid the rectangle defined by the longitudinal division M and yardage 430. Those rectangles are comprised at least in part by sand traps on the chart, and a ball landing anywhere within them is considered to have landed in the sand trap. No yardage penalty is suffered for a ball landing within one of those rectangles; the penalty is that the next shot must be taken from the zone designated 21 on the carpet of FIG. 1. Zone 21 is in part comprised of a tiny strip of carpet 36 attached to the playing surface to represent the conditions encountered in an actual sand trap. The player must position his ball in that portion of zone 21 which is behind strip 36, and shoot from that position to simulate a more difficult shot.

Previous reference was made to the fact that the game involves two types of water hazards. Water hazard 29 is a "lateral water hazard", whereas the area 30 on the chart of FIG. 2 delineated by the heavy line 31 is a "regular water hazard". The difference is that a regular water hazard is completely within the link, whereas a portion of a lateral water hazard is off the link. The only difference to a player between a regular and lateral water hazard is that a player whose ball lands on a rectangle corresponding to a regular water hazard on a chart does not have to move their marker laterally on the chart; he instead moves his marker backwardly on the chart to the first rectangle in the same longitudinal division which is free of the regular water hazard. For instance, a player whose ball landed on the carpet so as to correspond to rectangle V on FIG. 2 would move his marker to rectangle W and take his next shot accordingly.

The five types of penalty areas on the chart of the game can be summarized as follows:

| Position on which ball comes to rest | Next shot to be taken from | Penalty strokes suffered | Whether yardage gained is maintained | If yardage maintained, whether marker on chart is moved |
|---|---|---|---|---|
| Lateral Water Hazard | Zone 20 | one | yes | yes (laterally) |
| Regular Water Hazard | Zone 20 | one | partially | yes (backwardly) |
| Sand Trap | Zone 21 | none | yes | no |
| Roadway | TEE | two | no | — |
| Out-of-Bounds | TEE | two | no | — |

The circled numbers 3, 8, 13 and 16 on FIG. 1 represent par 3 links, and are the only links on which it is possible to shoot a hole-in-one. With respect to the four circled numbers on pre-putting region 12 of FIG. 1, a player's ball must completely land within the associated circled number on the first shot if a hole-in-one is to be recorded. Otherwise, the same rules are applicable to those four links as are applicable to the other fourteen links of the course, including the requirement that the putting region 13 be utilized for the final shot or shots.

Since the playing surface of the game is limited, certain rules are required with respect to a ball going out-of-bounds. If a ball should leave the pre-putting region 12 completely, the penalty is two lost strokes. Therefore, if the ball were to go out-of-bounds on the first shot, the next shot would be the third shot, would be from the tee, and the yardage of the first shot would not count. There is a one-stroke penalty for going out-of-bounds on putting region 13; the next shot is the second shot and is made from the same position as the shot that went out-of-bounds. If a player is shooting within the pre-putting region 12 and their ball lands past the 280 yardage zone but remains at least partially in the region, the player is credited with gaining 300 yards (a bonus of 10 yards being given for accuracy).

Other rules are also applicable to the game. A player may elect to take a score of 10 on any hole if his actual score exceeds that amount. Also, no negative yardage is possible in the sense that none of the chance selection cards can place a player in any worse position than having to shoot from the tee. To illustrate, if a player's first shot placed him in the chance zone 15 between yardage 110 and yardage 120 and if the card drawn in consequence required the player to lose 20 spaces, the player would still shoot their next shot from the tee. If a card were selected that required a lateral movement of the ball and such lateral movement placed the ball out-of-bounds then the player must repeat the situation as if he had in fact hit the ball out-of-bounds at that position. It should be mentioned with respect to the two piles of cards 17 and 18 that a small proportion of at least one of the set of cards has a provision whereby a player may elect to save the penalty or advantage listed on the card for use with a subsequent shot on the same or any subsequent link. That feature would be advantageous if a player should pick a card, for instance, providing no penalty for landing in a water hazard and the player's ball should subsequently land on that hazard. Another rule associated with the game is that if a player shoots from the wrong place and it is noticed before the link is completed, the player must add one stroke as a penalty on the link.

It should be obvious from the foregoing description of the basic game that strategic and putting skills are required similar to those utilized in a regular golf game. As earlier described, strategy is required in deciding how to approach each link depicted on a particular chart. It may not always be advantageous to go for a maximum distance and it may sometimes be wiser to go for a safer shot. Multiple variations in the rules of the basic game are possible. The game is supplied with blank cards on which players may include their own selection of penalties and bonuses prior to commencement of the game. Another consideration is that weaker players may use the "regular" tees while more advanced players may use the "championship" tees. Also handicaps may be awarded to weaker players. Other variations in the game are possible including players hitting the same ball as a team, or players playing under time restraints. The variations are virtually limitless.

I claim:

1. A golf game to be used in association with a golf club and a golf ball, the golf game comprising:

(a) a storable flexible medium having markings denoting a playing surface for the game, the surface being divided into a pre-putting region and a putting region by a line of demarcation, the pre-putting region having a tee-off zone proximate to one end thereof and having a series of target zones between the tee-off zone and a second end opposite said one end with the target zones extending parallel to the ends of the pre-putting region, the pre-putting region being also divided longitudinally between its ends such that each target zone has a central portion and at least one lateral portion on each side of the central portion;

(b) at least one chart depicting in plan view a link of a golf course, said at least one chart being divided by longitudinal and lateral lines, the longitudinal lines extending from the tee-off area toward the hole area and dividing said at least one chart into longitudinal divisions corresponding to the central portion and lateral portions of the target zones on the flexible medium, the distance represented by the separation between each adjacent pair of lateral lines having a relationship to the separation between lateral edges of the target zones; and (c) a series of markers for the at least one chart, the players of the game having mutually distinguishable markers; and whereby the game is played by each player in turn first hitting a ball from the tee-off zone of the pre-putting region of the flexible medium, then placing a marker at the position on the at least one chart corresponding to the longitudinal and lateral position at which the ball comes to rest on the flexible medium, then, according to the position of the marker on the at least one chart, rehitting the ball from the tee-off zone of the pre-putting region of the flexible medium and moving the marker to a position further along the at least one chart according to the new postion at which the ball comes to rest on the flexible medium, then repeating such hitting of the ball until the marker on the at least one chart is within a preselected distance of the hole on the at least one chart, then moving to the putting region of the flexible medium and hitting the ball until it moves within a hole designation in that region, the player then counting the number of hits of the ball required to move their marker to the hole on the at least one chart.

2. A golf game as in claim 1, and also comprising chance game movement selection means associated with certain of the target zones of the pre-putting region of the flexible medium; whereby when a ball hit by a player from the tee-off zone of the pre-putting region of the flexible medium comes to rest on the one of the target zones associated with the chance game movement selection means, the position of the marker of the player on the particular chart is modified according to the chance game selection means.

3. A golf game as in claim 2, wherein the chance game selection means comprises a series of cards each of which has described thereon a penalty or bonus, the player whose ball comes to rest on the one of the target zones associated with the chance game movement selection means having to randomly select one of the cards, the position of the marker of the player on the particular chart being moved according to the description on the chosen card, the penalty descriptions on the series of cards generally requiring the players to move back their markers on the board to some extent and the bonus descriptions on the series of cards generally requiring the players to advance their markers on the board to some extent.

4. A golf game as in claim 1, 2 or 3, wherein the storable flexible medium is a piece of carpet capable of being rolled up and wherein the direction of play in both the pre-putting and putting regions is parallel to the line of demarcation between the two regions.

5. A golf game as in claim 1, wherein the marking on the pre-putting region of the playing surface includes a series of small delineated areas each delineated area being located within a respective one of the target zones, a player whose ball comes to rest on one of such delineated areas on their first hit on the link being credited with scoring a hole-in-one on the link.

6. A golf game as in claim 3, wherein at least some of the series of cards, in addition to or separate from having a bonus or penalty described thereon, require the players to move their markers laterally on the board to some extent.

7. A golf game as in claim 1, wherein the charts are constructed of cardboard and wherein the markers are pins insertable into the cardboard.

* * * * *